US008154457B2

(12) United States Patent
Van Der Poel

(10) Patent No.: US 8,154,457 B2
(45) Date of Patent: Apr. 10, 2012

(54) ARRAY ANTENNA COMPRISING MEANS TO ESTABLISH GALVANIC CONTACTS BETWEEN ITS RADIATOR ELEMENTS WHILE ALLOWING FOR THEIR THERMAL EXPANSION

(75) Inventor: Stephanus Hendrikus Van Der Poel, Haaksbergen (NL)

(73) Assignee: Thales Nederland B.V., Hengelo (NL)

( * ) Notice: Subject to any disclaimer, the term of this patent is extended or adjusted under 35 U.S.C. 154(b) by 413 days.

(21) Appl. No.: 12/545,356

(22) Filed: Aug. 21, 2009

(65) Prior Publication Data

US 2010/0053026 A1 Mar. 4, 2010

(30) Foreign Application Priority Data

Aug. 28, 2008 (NL) ..... 1035878

(51) Int. Cl.
*H01Q 1/24* (2006.01)

(52) U.S. Cl. ..... 343/700 MS; 343/853; 342/372

(58) Field of Classification Search ..... 343/700 MS, 343/754, 853, 908; 342/175, 372
See application file for complete search history.

(56) References Cited

U.S. PATENT DOCUMENTS

| | | | | |
|---|---|---|---|---|
| 5,539,415 | A * | 7/1996 | Metzen et al. | 343/700 MS |
| 5,854,607 | A * | 12/1998 | Kinghorn | 343/853 |
| 5,940,031 | A * | 8/1999 | Turlington et al. | 342/372 |
| 6,166,705 | A * | 12/2000 | Mast et al. | 343/853 |
| 6,670,930 | B2 * | 12/2003 | Navarro | 343/776 |
| 6,876,323 | B2 | 4/2005 | Feldle et al. | |
| 7,348,932 | B1 * | 3/2008 | Puzella et al. | 343/853 |
| 7,443,354 | B2 * | 10/2008 | Navarro et al. | 343/777 |

* cited by examiner

*Primary Examiner* — Tho G Phan
(74) *Attorney, Agent, or Firm* — Stroock & Stroock & Lavan LLP

(57) ABSTRACT

There is disclosed an apparatus comprising a plurality of three-dimensional radiator elements, each radiator element transmitting or receiving electromagnetic waves. The radiator elements are arranged so that at least one pair of adjacent radiator elements are separated by a gap, which behaves like a waveguide inducing by a coupling effect electromagnetic interferences with the waves. The apparatus includes a portion to establish a galvanic contact between the adjacent radiator elements, so as to suppress the coupling effect, while allowing for the thermal expansion of the adjacent radiator elements.

6 Claims, 2 Drawing Sheets

Figure 1A:
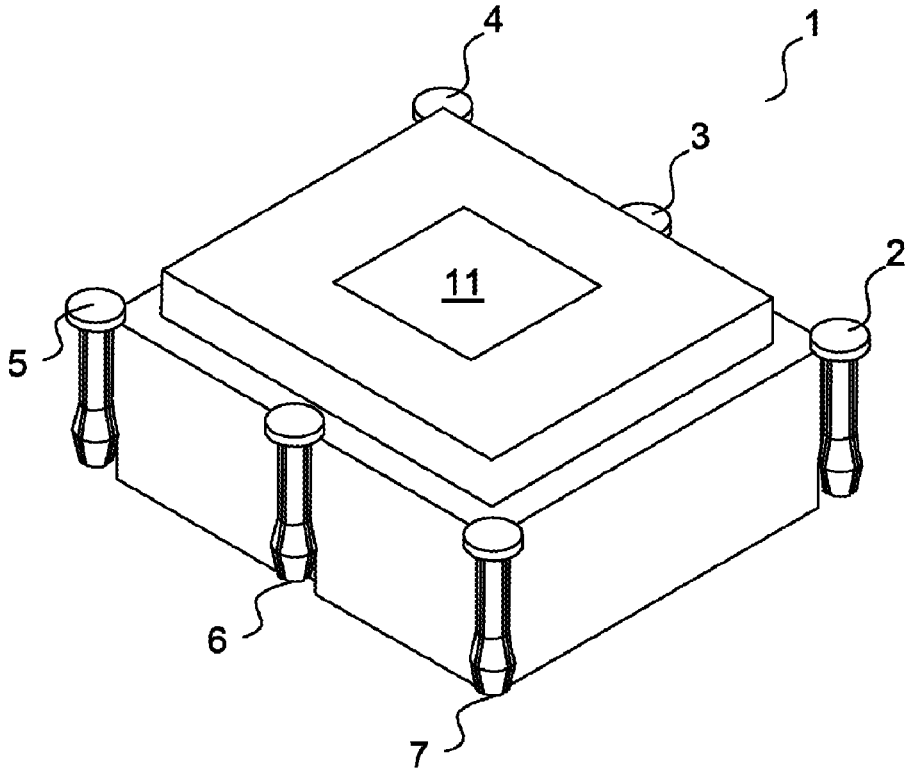

ARRAY ANTENNA COMPRISING MEANS TO ESTABLISH GALVANIC CONTACTS BETWEEN ITS RADIATOR ELEMENTS WHILE ALLOWING FOR THEIR THERMAL EXPANSION

The present application claims the benefit of the Dutch Patent Application No. 1035878 filed Aug. 28, 2008, which hereby is incorporated by reference in its entirety.

The present invention relates to an array antenna comprising means to establish galvanic contacts between its radiator elements while allowing for their thermal expansion. For example, the invention is particularly applicable to antenna modules for radar and telecom.

Nowadays radar systems may use a scanning phased array antenna to cover their required angular range. Such an antenna comprises a large number of identical radiator elements assembled onto a panel, so as to form a grid of radiator elements. The control of the phase shifting between adjacent radiator elements enables to control the scanning angle of the beam emitted by the array antenna. The techniques that are the most commonly used to build an array antenna are based on interconnect substrate technologies, e.g. the Printed Circuit Board technology (PCB). These thick-film or thin-film multilayer technologies consist in many sequential steps of laminating layers, of drilling holes through the layers and of metallizing the holes. These sequential build-up technologies typically result in planar interconnect devices comprising multiple interconnection layers. However, the next generation of compact scanning phased array antennas require Radio-Frequency (RF) radar functionalities to be implemented directly at the antenna face, such as Active Electronically Scanned Array (AESA) antennas for example. This cannot be achieved by the above mentioned techniques, as they typically result in planar interconnect devices that do not afford extra room to embed the required RF components. This is one of the technical problems that the present invention aims at solving.

The use of 3D-shaped radiator elements, so-called radiator packages, may afford sufficient extra interior room. It is worth noting that a 3D radiator package also yields design possibilities in terms of bandwidth and scan-angle that a planar device radiator cannot. The general aspect of a radiator package is that of a hollowed box topped by an integrated antenna. A large number of freestanding radiator packages are assembled onto a PCB so as to form a grid of radiator packages, by picking and placing them onto the board as surface mounted devices (SMD). So-called "unit cells" are used as footprints to mount the radiator packages onto the PCB. A unit cell determines the space available for each radiator package onto the PCB. The width and the length of a unit cell is determined by the type of grid (rectangular grid or triangular grid) and by the required performance, in terms of free space wavelength and of scanning requirements. Units cells are printed at the surface of the PCB according to a triangular grid pattern or a rectangular grid pattern, thus providing a convenient mean to arrange the radiator packages onto the PCB. Unfortunately, gaps are left between the radiator packages. The depth of these gaps is equal to the height of a unit cell, which is determined by the dimensions and the layout of the RF components that must be embedded inside the radiator elements. Consequently, the depth of the gaps cannot be adjusted.

Basically, these gaps result from the necessary tolerances required by the process of placing and assembling the radiator packages. Practically, the width of the gaps can be limited to a minimum, as long as it allows for placement on the PCB and as long as it allows for thermal expansion and cooling of the radiator packages. Thus, doing without the gaps is not workable. Unfortunately, these "mechanical gaps" incidently form "RF gaps" behaving like waveguides, into which the electromagnetic energy radiated by the packages partly couples. Reflected in the bottom of the gaps by the PCB, undesired interference with the directly emitted energy into free space are generated. Depending on the height of the radiator packages and on the wavelength, the gaps may induce mismatch scanning problems for some of the required scanning angle, for example the scanning angles up to 60 degrees in all directions. This is another technical problem that the present invention aims at solving. It is worth noting that, in a large bandwidth antenna, minimizing the width of the gaps may only alleviate the problem. Minimizing the width of the gaps cannot solve the problem.

An existing solution consists in an array of radiator packages attached to a board by means of conducting bolts. The boltheads short-circuit the conductive sidewalls of the adjacent radiator packages by virtue of contact shims, thus suppressing undesired waveguide modes inside the gaps. However, if the array antenna comprises a lot of radiator packages, this solution leads to a very complex assembly, which is bound to hamper any later maintenance or repair operation. Actually, removing an individual radiator element may turn into a challenge in regard of the very high level of integration of nowadays systems, as it implies unscrewing several bolts with special tools and handling with tiny shims. Another major disadvantage of this solution is that the use of bolts inserted between the radiator elements do not allow for proper thermal expansion, thus requiring the use of an additional high-performance cooling system. These are other technical problems that the present invention aims at solving.

In an attempt to provide a radar system that requires little room whereas the radiator packages are easily interchangeable for maintenance or repair work, the U.S. Pat. No. 6,876,323 discloses a radar system with a phase-controlled antenna array. The disclosed system comprises a plurality of data and supply networks interchangeably arranged and a plurality of transmit/receive modules (e.g.: 3D radiator packages) arranged interchangeably on a radiation side of the radar system. The sender/receiver modules are said to be exchangeable either from the irradiation side or from the front side of the radar system equally. However, the disclosed system comprises narrow gaps between the exchangeable sender/receiver modules, these gaps necessarily behaving like waveguides into which the radiated electromagnetic energy couples. Consequently, the system disclosed in the U.S. Pat. No. 6,876,323 is not adapted to angular scanning.

The present invention aims to provide an apparatus which may be used to overcome at least some of the technical problems described above. At its most general, the present invention described hereafter may provide an apparatus comprising a plurality of three-dimensional radiator elements, each radiator element transmitting or receiving electromagnetic waves. The radiator elements are arranged so that at least one pair of adjacent radiator elements are separated by a gap, which behaves like a waveguide inducing by a coupling effect electromagnetic interferences with the waves. The apparatus comprises means to establish a galvanic contact between the adjacent radiator elements, so as to suppress the coupling effect, while allowing for the thermal expansion of the adjacent radiator elements.

In a preferred embodiment, each radiator element may transmit or receive electromagnetic waves by its radiating top side, the radiator elements being arranged so that their radiating top sides are in a same plane.

For example, the means may comprise a resilient body topped by a conductive head. The resilient body may be inserted in the gap while the conductive head may be in contact with the radiating top sides of the adjacent radiator elements.

Advantageously, sidewalls of the adjacent radiator elements facing the gap may be grooved and/or may have their edges dug, the resilient body being inserted in the gap at a location where grooves and/or dug edges (i.e., concavely-dug corner edges) face each other.

In a preferred embodiment, the resilient body may be a metallic cylinder longitudinally cut by slots, the grooves being round-shaped and/or the edges being dug in a round shape.

In a preferred embodiment, the resilient cylindrical body may comprise a protuberant end, the round-shaped grooves and/or the round-shaped dug edges having a greater radius in their bottom part so as to form a cavity. The means may lock in the gap when the protuberant end nests into the cavity, the conductive head concurrently establishing galvanic contact between the top sides of the adjacent radiator elements.

The three-dimensional radiator elements may be mounted onto a PCB by their sides opposite to their radiating top sides, so as to form an array of three-dimensional radiator elements. The three-dimensional radiator elements may be arranged so as to form an array of the triangular type, for a scanning phased array antenna for example.

In any of its aspects, the invention disclosed herein conveniently provides a true pick and place solution of the SMD type, which enables to easily assemble individual 3D radiator packages together in an array configuration. It allows for easy placement of the 3D radiator packages on a PCB, for thermal expansion and for cooling. Implemented in a scanning phased array antenna, it allows for large scan angles without mismatch scanning problems and it allows for large bandwidth performance. Exchanging an individual 3D radiator element does not require an unusual effort or special tooling.

Figure 1B:
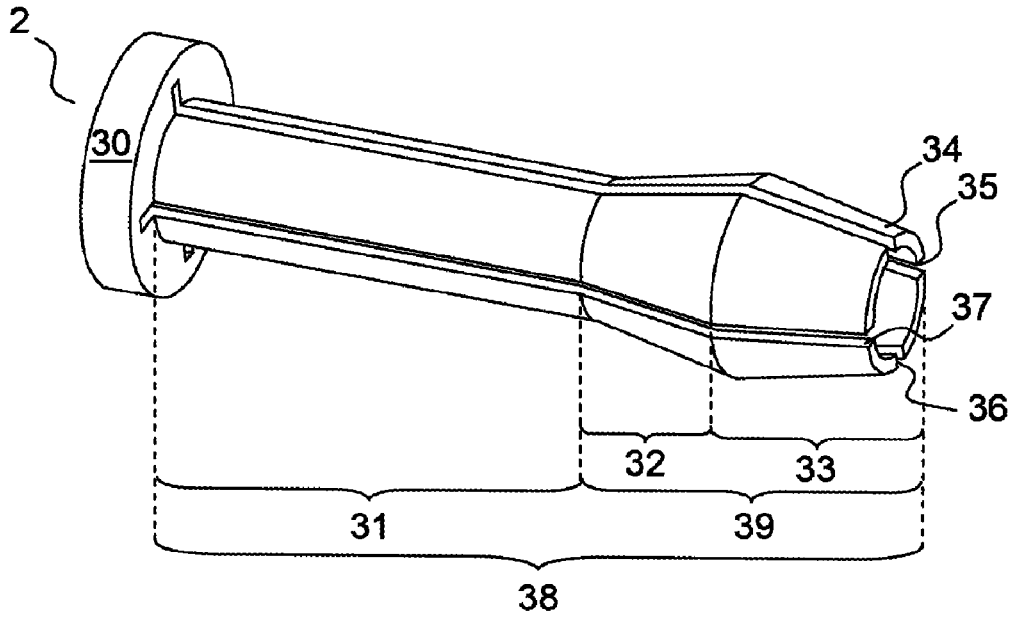
Figure 2:
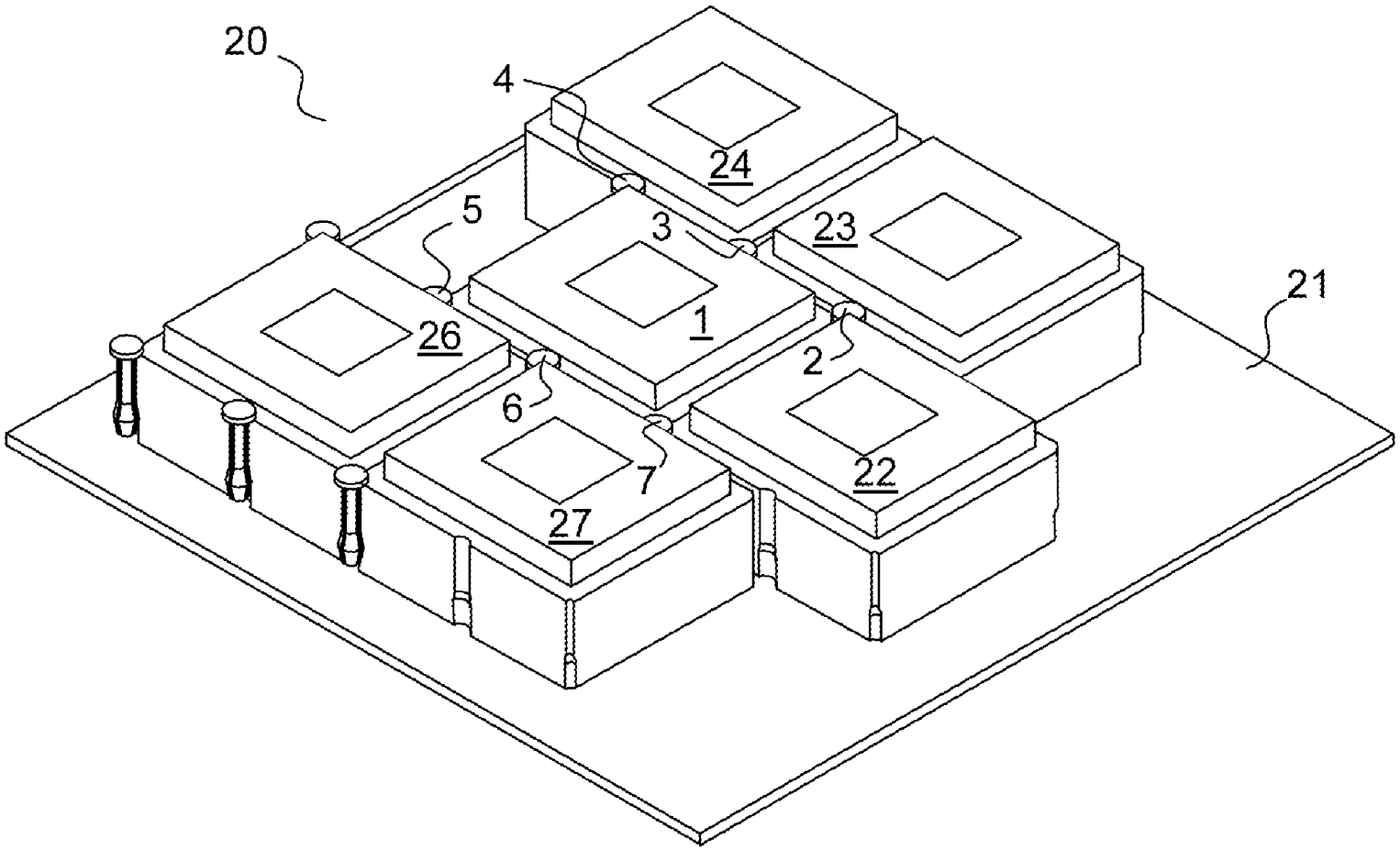

A non-limiting exemplary embodiment of the invention is described below with reference to the accompanying drawings in which:

- the FIG. 1*a* schematically illustrates by a perspective view an exemplary 3D radiator package according to the invention;
- the FIG. 1*b* schematically illustrates by a perspective view an exemplary conductive resilient clip according to the invention;
- the FIG. 2 schematically illustrates by a perspective view an exemplary 3×2 array of 3D radiator packages according to the invention.

FIG. 1*a* schematically illustrates by a perspective view an exemplary 3D radiator package 1 according to the invention. The radiator package 1 can be fabricated by different technologies. For example, LTCC technology (Low-Temperature, Cofired Ceramic) or 3D MID technology (3-Dimensional Molded Interconnect Device technology) are suitable. For example, the radiator package 1 may comprise at its radiating top side a patch antenna 11. Conductive resilient clips 3 and 6 are each arranged in the middle of a sidewall of the radiator package 1. Conductive resilient clips 2, 4, 5 and 7 are each arranged at an edge of the radiator package 1.

FIG. 1*b* focuses on the exemplary clip 2 by a perspective view. In the illustrated embodiment, the clip 2 may comprise a disc-shaped solid head 30 attached to a hollow body 38. The hollow body 38 comprises a cylindrical hollow rod 31 attached to a hollow end 39. The hollow end 39 comprises a first truncated cone 32 attached to a second truncated cone 33 by a common base. Advantageously, the radius of the common base attaching the two truncated cones 32 and 33 may be greater than the radius of the cylinder constituting the hollow rod 31, so as to form a protuberance. In the illustrated embodiment, four slots 34, 35, 36 and 37 may cut longitudinally the hollow body 38, so that the two truncated cones 32 and 33 as well as the cylinder constituting the hollow rod 31 are divided into four identical quadrant-shaped pins. Advantageously, the whole clip 2 may be made of a material having conductive and resilient properties, such as metal for example. Hereby, the four identical quadrant-shaped pins allow for slight radial movements, thus reducing or expanding the radial dimensions of the hollow body 38.

As illustrated by FIG. 1*a*, the locations in the middle of a sidewall where a clip is to be arranged may be grooved, while the edges where a clip is to be arranged may be made smooth. However, as illustrated by the preferred embodiment of FIG. 1*a*, the grooves may be round-shaped so as to enable the resilient cylindrical hollow body 38 to slide easily into the grooves. Similarly, the edges may be dug in a round shape so as to enable the resilient cylindrical hollow body 38 to slide easily into the so-formed round-shaped dug edges. Preferably, the round-shaped grooves and the round-shaped dug edges may have a greater radius in their bottom part, so as to form a cavity into which the hollow end 39 may nest.

FIG. 2 schematically illustrates by a perspective view an exemplary 3×2 array 20 of six 3D radiator packages arranged in a triangular grid onto a PCB 21 according to the invention, comprising radiator packages 22, 23, 24, 26 and 27 identical to the radiator package 1. For example, the radiator packages 1, 22, 23, 24, 26 and 27 may be bonded onto the PCB 21 by their side opposite to their radiating top side, so that their radiating top sides are advantageously in a same plane. Bonded by a usual process, no fastening items such as bolds are needed. The so-formed array may be used to build a scanning phased array antenna. The radiator package 1 is neither in contact with the radiator package 22, nor in contact with the radiator package 23, nor in contact with the radiator package 24, nor in contact with the radiator package 26, nor in contact with the radiator package 27. The radiator package 1 is separated from those adjacent packages 22, 23, 24, 26 and 27 by a linear 'mechanical gap'. By virtue of its resilience property, the clips 2 may be inserted in the gap at a location where a groove in a sidewall of the radiator package 23 faces two dug edges of the radiator packages 1 and 22. By virtue of its resilience property, the clip 3 may be inserted in the gap at a location where a groove in a sidewall of the radiator package 1 faces two dug edges of the radiator packages 23 and 24. By virtue of its resilience property, the clip 4 may be inserted in the gap at a location where a groove in a sidewall of the radiator package 24 faces a dug edge of the radiator package 1. By virtue of its resilience property, the clip 5 may be inserted in the gap at a location where a groove in a sidewall of the radiator package 26 faces a dug edge of the radiator package 1. By virtue of its resilience property, the clip 6 may be inserted in the gap at a location where a groove in a sidewall of the radiator package 1 faces two dug edges of the radiator packages 26 and 27. By virtue of its resilience property, the clip 7 may be inserted in the gap at a location where a groove in a sidewall of the radiator package 27 faces two dug edges of the radiator packages 1 and 22. It is worth noting that inserting the clips is very easy. For example, the resilient clip 2 may be inserted by simply pushing on its head 30. The clip 2 may "lock" when its hollow end 39 expands back in the cavity formed by the round-shaped groove in the sidewall of the radiator package 23 and the round-shaped dug edges of the radiator package 1 and 22 in their bottom parts. In the illustrated embodiment, the conductive head 30 may simultaneously come into tight galvanic contact with the tops of the adjacent packages 1, 22 and 23, hereby preventing the gap between these packages to behave like a waveguide, while the resilient cylindrical hollow body 38 allows for thermal expansion and cooling of the adjacent packages 1, 22 and 23. It is worth noting that removing the clips is very easy too, no special tooling being needed. For example, the resilient clip 2 can be removed by simply pulling its head 30, the cone-shaped hollow end 39 coming easily out from the cavity formed by the round-shaped grooves and the round-shaped dug edges in their bottom parts. After removing the clips 2, 3, 4, 5, 6 and 7, the radiator package 1 can easily be picked out from the PCB 21 by a usual process.

It is to be understood that variations to the example described above, such as would be apparent to the skilled addressee, may be made without departing from the scope of the present invention. Especially, the radiator packages 1, 22, 23, 24, 26 and 27 could be arranged in a rectangular grid onto the PCB 21 according to the invention.

Conveniently, the invention disclosed herein leaves free choice of the height of the 3D radiator packages to accommodate the RF components at the inside of the radiator packages, the only condition being to adapt the height of the clips.

The invention claimed is:

1. A multiple radiator element apparatus comprising:

a plurality of three-dimensional radiator elements, each three-dimensional radiator element comprising:

a plurality of sidewalls, at least one sidewall having at least one of a rounded groove and a concavely-dug corner edge;

a radiating top side substantially perpendicular to the plurality of sidewalls, the radiating top side transmitting or receiving electromagnetic waves, the three-dimensional radiator elements arranged so that at least one pair of adjacent three-dimensional radiator elements are separated by a gap and so that their radiating top sides are in a substantially same plane, the gap forming a waveguide that couples by a coupling effect an electromagnetic interference with the electromagnetic waves; and each radiator element further comprising a bottom side opposite from the radiating top side; and the multiple radiator element apparatus further comprising a metallic cylinder having a top end and a bottom end opposite from the top end, the top end having a conductive head in galvanic contact with the radiating top sides of the adjacent three-dimensional radiator elements, the metallic cylinder having longitudinally cut slots so as to form a resilient cylindrical body, wherein the resilient cylindrical body is inserted in the gap at a location where at least two of the rounded grooves or the concavely-dug corner edges face each other, wherein the metallic cylinder suppress the coupling effect, while allowing for a thermal expansion of adjacent three-dimensional radiator elements.

2. A multiple radiator element apparatus according to the claim 1, wherein:

the resilient cylindrical body further comprises a protuberant end joined to the bottom end of the metallic cylinder;

the rounded grooves or the concavely-dug corner edges have a greater radius in their respective bottom parts as compared to a radius of their respective top parts, so as to form a cavity between facing rounded grooves or concavely-dug corner edges; and the resilient cylindrical body being locked in the gap when the protuberant end nests into the cavity between facing rounded grooves or concavely-dug corner edges.

3. A multiple radiator element apparatus as claimed in claim 2, wherein the three-dimensional radiator elements are mounted onto a printed circuit board by their respective bottom sides, so as to form an array of three-dimensional radiator elements.

4. A multiple radiator element apparatus as claimed in claim 3, wherein the three-dimensional radiator elements are arranged so as to form a triangular array.

5. A multiple radiator element apparatus as claimed in claim 4, wherein the array of three-dimensional radiator elements forms an array antenna.

6. A multiple radiator element apparatus as claimed in claim 5, wherein the array antenna comprises a scanning phased array antenna.

* * * * *